US007063030B2

(12) United States Patent
Mizutani

(10) Patent No.: US 7,063,030 B2
(45) Date of Patent: Jun. 20, 2006

(54) ELECTRIC STEERING APPARATUS FOR WATERCRAFT

(75) Inventor: Makoto Mizutani, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/075,131

(22) Filed: Mar. 8, 2005

(65) Prior Publication Data

US 2005/0199168 A1 Sep. 15, 2005

(30) Foreign Application Priority Data

Mar. 9, 2004 (JP) ..... 2004-065689

(51) Int. Cl.
*B63H 25/00* (2006.01)

(52) U.S. Cl. ..... 114/144 R; 440/84

(58) Field of Classification Search ..... 114/144 A, 114/144 E, 144 R, 144 RE, 150; 440/58, 440/62, 63, 84; 701/41, 42, 43
See application file for complete search history.

(56) References Cited

U.S. PATENT DOCUMENTS 6,273,771 B1 * 8/2001 Buckley et al. ..... 440/84
6,535,806 B1 * 3/2003 Millsap et al. ..... 701/42
6,678,596 B1 * 1/2004 Husain et al. ..... 701/41

FOREIGN PATENT DOCUMENTS

JP 2739208 B2 1/1998
JP 10/226346 8/1998
JP 2959044 B2 7/1999

OTHER PUBLICATIONS

Co-Pending U.S. Appl. No. 11/075,129 filed Mar. 8, 2005. Title: Steering Assist System for Boat. Inventor: Makoto Mizutani.
Co-Pending U.S. Appl. No. 11/074,805 filed Mar. 8, 2005. Title: Steering System for Boat. Inventor: Makoto Mizutani.

* cited by examiner

*Primary Examiner*—Lars A. Olson
(74) *Attorney, Agent, or Firm*—Knobbe, Martens, Olson & Bear, LLP

(57) ABSTRACT

An electric steering apparatus can include a rudder device driven by an electric motor, a steering wheel for operation by an operator to control the angle of the rudder device, a reaction torque motor for applying a reaction force to the steering wheel, a load sensor for detecting an external force acting on a boat or the rudder during steering, and a reaction torque calculator circuit for calculating a target torque for the reaction motor according to an input of the load sensor.

8 Claims, 5 Drawing Sheets

ELECTRIC STEERING APPARATUS FOR WATERCRAFT

PRIORITY INFORMATION

This application is based on and claims priority to under 35 U.S.C. § 119 to Japanese Patent Application No. 2004-065689 filed Mar. 9, 2004, the entire contents of which is hereby expressly incorporated by reference.

BACKGROUND OF THE INVENTION

1. Field of the Invention

The present inventions relate to an electric steering system for a small boat, and in particular, to steering systems that provide variable steering response.

2. Description of the Related Art

Japanese Patent No. JP-B-2739208 discloses an electric steering apparatus for watercraft using an electric motor for changing the steering angle of an outboard motor. The electric steering apparatus disclosed therein includes a sensor for detecting the rotational angle and direction of operation of a steering wheel, as well as a controller for controlling the electric motor of the steering device based on a detection signal from the sensor. The steering wheel is electronically connected to the electric motor via the sensor and the controller. This configuration allows steering of a boat by driving the electric motor according to an operation amount of the steering wheel.

With such an electric steering apparatus, however, no feedback force is provided to the operator. For example, when wind or other water currents exert loads on the outboard motor, the operator is unaware of any such loads. Thus, the operator cannot feel those external forces which can manifest themselves as a heavy or light feel of the steering wheel during operation. These external forces can be caused by waves, wind, etc. As such, the operator is less able to respond to such loads and thus is less able to quickly respond to such loads. More experienced operators of boats using cable-type steering connections can feel these loads and react quickly to keep the watercraft on a desired course.

Other forces also affect the steering of watercraft. For example, the rotation of a propeller in the vicinity of a rudder can create a hydrodynamic effect that generates a load against the rudder; the effect is known as a "paddle-rudder effect." This effect can alter the course of a boat during operation.

The paddle-rudder effect is described in Japanese Patent No. JP-B-2959044, in which the paddle-rudder effect is referred to as a "gyro effect." The paddle-rudder effect can cause a boat to proceed in a direction that is deflected to the left or to the right by a certain angle offset from the angle that would result from the rudder position if the boat were coasting with no rotation of the propeller. In other words, even where the steering wheel is set at a neutral position (a zero steering angle), the boat proceeds at an angle offset from a straight ahead direction.

The JP-B-2959044 patent discloses a technique for compensating for the paddle-rudder effect (gyro effect) by applying a predetermined torque to the rudder according to the steering wheel operation angle. In this technique, however, a constant torque is required to be applied via an electric motor in such a direction so as to cancel the paddle-rudder effect. This results in a continuous power consumption by the electric motor at all times.

Further, the technique disclosed in JP-B-2959044 does not compensate for the lack of feedback feeling in the steering wheel, nor does it describe a system that can provide reaction forces at the steering wheel. Thus, with the system and technique disclosed in the JP-B-2959044 patent, it is impossible to obtain an operating feeling depending on the steering wheel operation or a driving feeling through the steering wheel. Thus, it is difficult to recognize imminent course changes that may result from the waves, wind or the paddle-rudder effect and to quickly respond to these forces to maintain a desired course.

Japanese Patent Publication No. JP-A-HEI 10-226346 discloses an electric steering system for an automobile. In this system, a reaction force motor applies a reaction force to the steering wheel of the automobile to communicate reaction forces exerted from the ground equally through the left and right tires of the automobile. This control technique for automobiles is not simply applicable to boats, which receive a force due to the paddle-rudder effect described above, as well as other effects.

SUMMARY OF THE INVENTION

An aspect of at least one of the embodiments disclosed here and includes a realization that providing feedback or reaction forces to the steering wheel of a watercraft allows the operator of the watercraft to respond more quickly to imminent course changes of the watercraft. Further, additional advantages are achieved where certain forces exerted on the watercraft are filtered and thus not transmitted to the steering wheel as feedback.

Thus, in accordance with an embodiment, a steering apparatus for a boat comprises a rudder device driven by an electric actuator arranged to change a running direction of the boat. A steering wheel is configured to operable by an operator of the boat. The steering wheel is electrically connected to the electric actuator so as to feed a drive signal to the electric actuator according to an amount of operation. A load sensor is configured to detect an external force that acts on the boat during running. A reaction torque motor is configured to apply a reaction force to the steering wheel. Additionally, a reaction torque calculation module configured to calculate a target torque for the reaction torque motor according to an output of the load sensor.

In accordance with another embodiment, a steering apparatus for a boat comprises a rudder device driven by an electric actuator arranged to change a running direction of the boat. A steering wheel is configured to operable by an operator of the boat. The steering wheel is electrically connected to the electric actuator so as to feed a drive signal to the electric actuator according to an amount of operation. A load sensor is configured to detect an external force that acts on the boat during running. A reaction torque motor is configured to apply a reaction force to the steering wheel. Additionally, the steering apparatus includes means for calculating a target torque for the reaction torque motor according to an output of the load sensor.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit, the inventions. The drawings contained the following figures.

DETAILED DESCRIPTION OF THE PREFERRED EMBODIMENT

Figure 1:
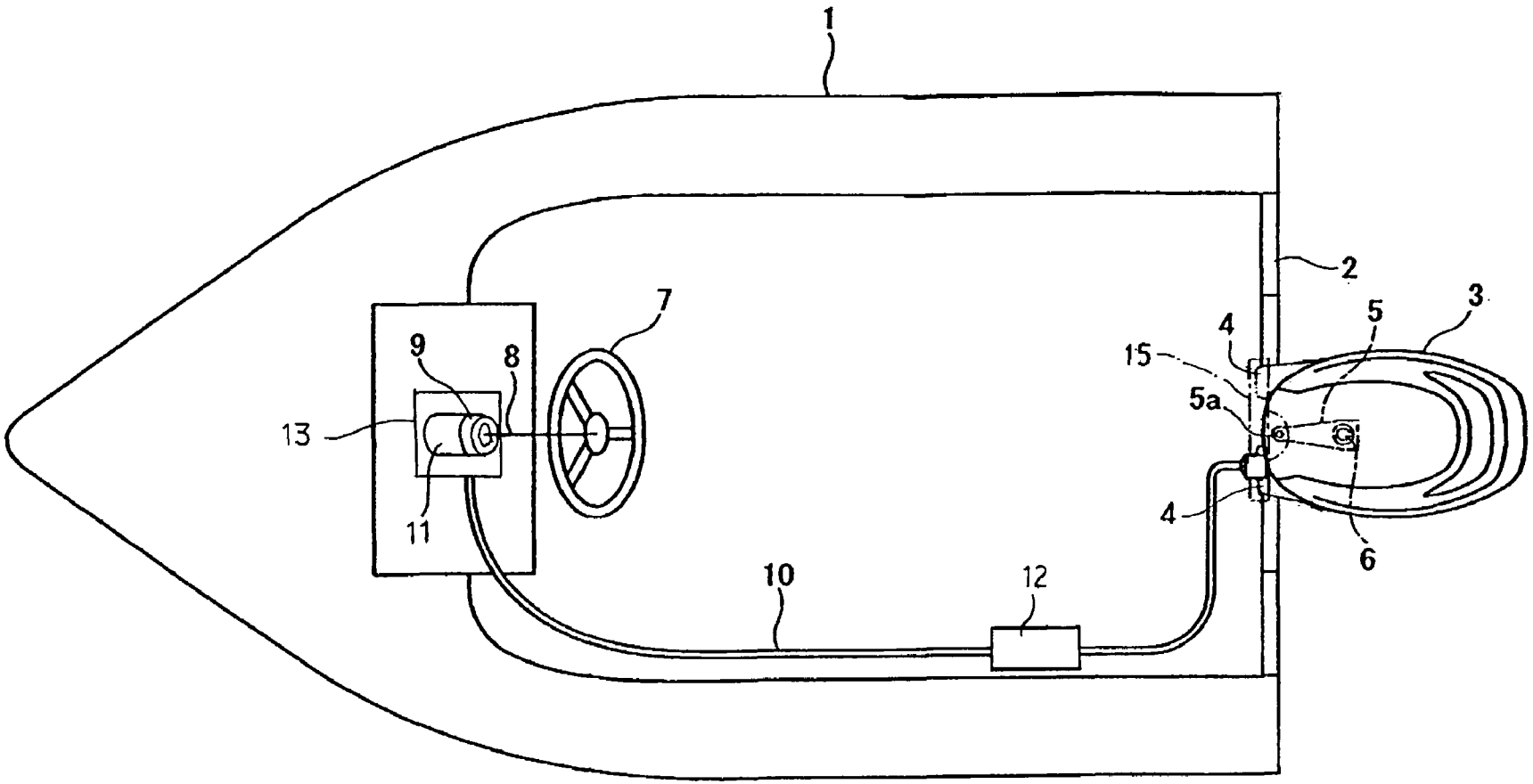
FIG. 1 is schematic top plan view of a watercraft, including an electric steering system and in accordance with an embodiment.

FIG. 1 is a schematic top plan view of a small boat or watercraft, including an outboard motor with which the present embodiments are applicable. The embodiments disclosed herein are described in the context of a marine propulsion system having an electric steering system for a small boat because these embodiment have particular utility in this context. However, the embodiments and inventions herein can also be applied to other marine vessels with stern drives, personal watercraft, small jet boats, as well as other vehicles.

With reference to FIG. 1, an outboard motor 3 can be mounted to a transom plate 2 of a hull 1 of a small boat or watercraft with clamp brackets 4. As used herein, the terms "small boat" and "watercraft," are used interchangeably.

The outboard motor 3 is mounted to be rotatable about a swivel shaft (or "steering shaft") 6. A steering bracket 5 is fixed to an upper end of the swivel shaft 6.

A rudder device 15 can be connected to an end 5*a* of the steering bracket 5. The rudder device 15 can include, for example, a DD (direct drive) type electric motor, including a motor body (not shown). The motor body is configured to slide along a threaded shaft (not shown) that is disposed so as to extend generally parallel with the transom plate 2. The steering bracket 5 is connected to the motor body to allow the outboard motor 3 to rotate about the swivel shaft 6 in conjunction with the sliding motion of the motor body.

A steering wheel 7 can be provided in the vicinity of an operator's seat (not shown) mounted to the hull 1. A steering wheel control section 13 can be provided at the root or base of a steering column shaft 8 to which the steering wheel 7 can be rotatably connected.

A steering wheel operation angle sensor 9 and a reaction torque motor 11 can be provided inside the steering wheel control section 13. However, other locations are also possible. The steering wheel control section can be connected, via a signal cable 10, or other connection means, to a controller 12, which in turn is connected to the rudder device 15.

The controller 12 can be configured to calculate a steering torque based on a detection signal from the steering wheel operation angle sensor 9. The calculated steering torque can be sent to the rudder device 15 as an electric command signal, to drive the rudder device so as to allow the outboard motor 3 to rotate about the swivel shaft 6 for steering the hull 1.

The controller 12 can also be configured to detect an external force (rotational torque applied to the swivel shaft 6) that acts on the outboard motor 3. For example, a load sensor 16 (see FIG. 2) can be provided in the outboard motor 3 or the rudder device 15. The output of the load sensor 16 can be configured to correspond to a load applied to the outboard motor 3 from, for example, external sources.

The controller 12 can be configured to receive the signal from the load sensor 16 and based on this signal, calculate a target value for a reaction torque to be applied to the steering wheel 7. The controller 12 can be configured to create a reaction torque signal that can be used to create a reaction force corresponding to the external force. The reaction force signal can be used to control the reaction torque motor 11 to create a reaction force at the steering wheel 7. The controller, thus, can be configured to drive the reaction torque motor 11 in accordance with the target torque, and thereby apply reaction force corresponding to the external force to the steering wheel 7.

The magnitude of the reaction torque applied to the steering wheel 7 can be in a proportional relationship to the load detected by the load sensor 16. As used herein, the term "proportional" encompasses relationships whether they are linear or nonlinear. For example, the term "proportional" is intended to encompass relationships where incremental changes in an external force on the outboard motor 3 or in the signal generated by the loan sensor 16 is read by the controller 12 and, based on the signal, the controller 12 emits a reaction torque motor signal to control the reaction torque motor 11 to provide a torque on the steering wheel 7 that is incrementally changed in accordance with the incremental change of the external force or the output of the load sensor 16.

Figure 2:
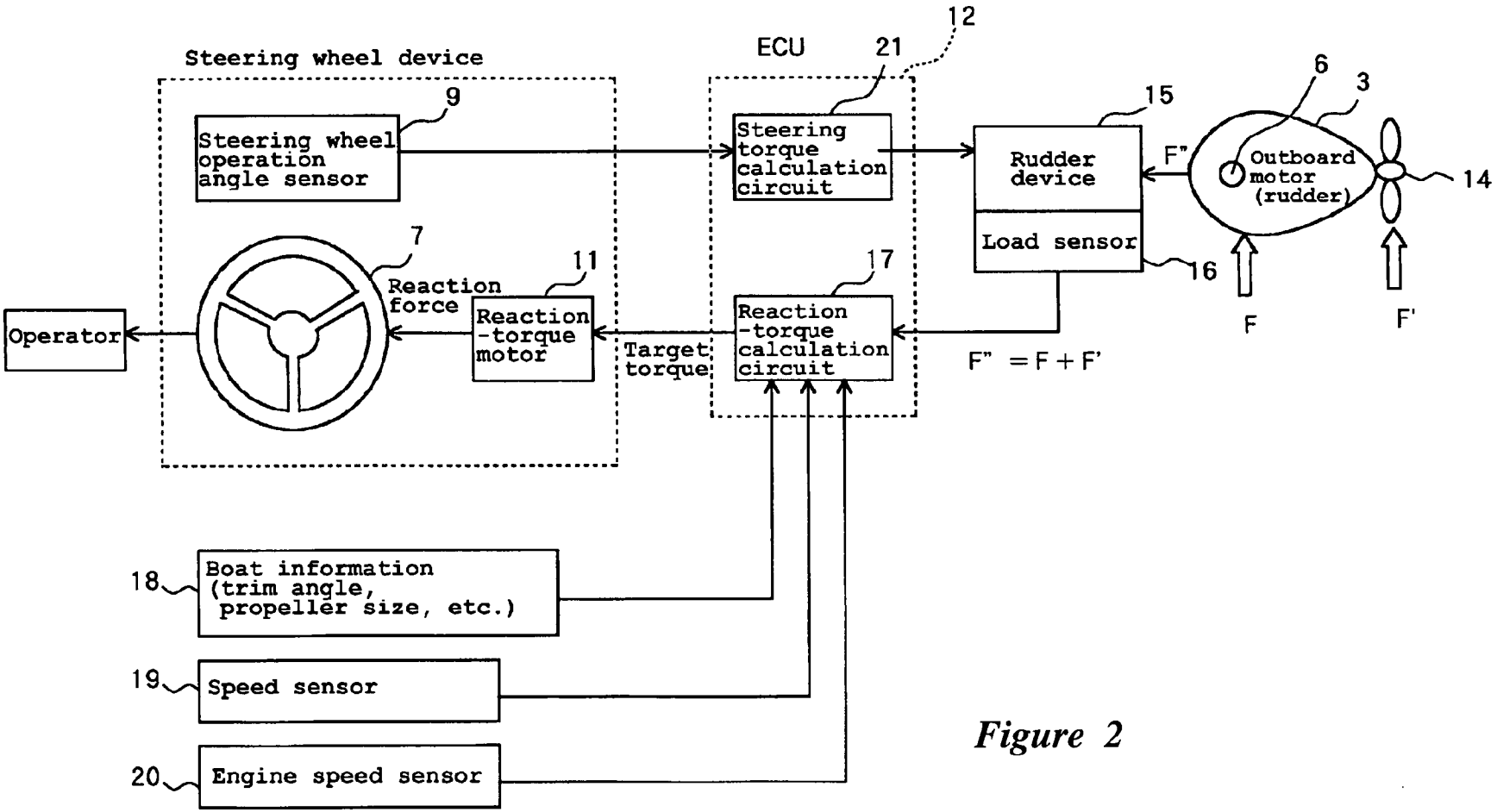
FIG. 2 is a block diagram of the steering system illustrated in FIG. 1.

FIG. 2 is a block diagram of the electric steering system according to an embodiment. In operation, when an operator rotates the steering wheel 7, the angle through which the steering wheel 7 is rotated, is detected by the steering wheel operation angle sensor 9. As noted above, the steering wheel operation angle sensor 9 is configured to emit a signal indicative of the angle through which the steering wheel 7 is rotated. Based on the detection signal from the sensor 9, a steering torque calculation circuit 21 of the controller (ECU) 12 calculates a steering torque. The controller 12 then drives the electric motor (not shown) of the rudder device 15. This allows the outboard motor 3 to swing about the swivel shaft 6, to change the direction of heading of the hull 1.

It is to be noted that the "circuits" noted herein can be in the form of a hard wired feedback control circuits. Alternatively, such "circuits" can be constructed of a dedicated processor and a memory for storing a computer program configured to perform the noted methods. Additionally, such "circuits" can be constructed of a general purpose computer having a general purpose processor and the memory for storing the computer program for performing the noted methods. Preferably, however, the "circuits" disclosed herein are incorporated into the ECU 12, in any of the above-mentioned forms. The term "module" as used herein, is meant to include any form of the "circuits" including hard-wired, dedicated processor and program, or general purpose processor and software.

During the steering operation, an external force F can be exerted upon the outboard motor 3, the lower portion of which acts like a rudder. The forces can include, but without limitation, wind, waves, and resistive forces against the swinging motion of the outboard motor 3. Additionally, a force F' can be generated due to the paddle-rudder effect resulting from the rotation of propeller 14 and its hydrodynamic interaction with the lower end of the outboard motor 3, which as known in the art, operates like a rudder. The paddle-rudder effect can generate a force F' with a generally constant magnitude and direction or vector. A resultant force F" can be expressed as the combination of the external force F and the force generated by the paddle-rudder effect F'.

The load sensor 16, which can be provided in the rudder device 15, is configured to detect the resultant force F" of the external force F added with the force due to the paddle-rudder effect F'. The detection data, or in other words, the output signal from the load sensor 16 which is indicative of the resultant force F", can be sent or transmitted to the reaction torque calculation circuit 17 of the controller 12.

The reaction torque calculation circuit 17 can be configured to receive other inputs, including, for example, but without limitation, boat information 18 regarding the trim angle, propeller size, and the like, detection data from a speed sensor 19 that can be configured to detect a speed of the boat, and an engine speed data from an engine speed sensor 20. The reaction torque calculation circuit 17 can be configured to calculate a target torque for a reaction force to be applied to the steering wheel 7.

For example, the reaction torque calculation circuit 17 can be configured to calculate the target torque based on the boat information noted above such as the detection data on the boat speed and the engine speed, along with the detection data on the foregoing resultant force F". The calculated target torque can then be sent to the reaction torque motor 11 as an electric command signal. The reaction torque motor 11 can be configured to apply a reaction force to the steering wheel 7 based on the command signal from the reaction torque calculation circuit 17.

The above-noted load sensor 16 can be configured to detect a rotational torque applied to the steering shaft for a rudder or the outboard motor 3. The rotational torque can be produced from external forces from water flow and the like. Thus, even when the rudder is not operated to move or rotate about its swivel shaft, a force that will move the boat rotationally can be exerted on the rudder or the outboard motor 3 due to the water flow and the like, and thus result in a rotational torque applied to the steering shaft. The load sensor 16 can be in the form of, for example, but without limitation, a shaft torque sensor that directly detects a shaft's torque. In some embodiments, the load sensor 16 can comprise detection means such as a distortion sensor that performs periodic measurements on a portion of the steering apparatus to which the shaft torque is transmitted.

Hence, a reaction torque applied to the steering wheel 7 can be calculated using factors, including the boat speed data, as well as optionally other data. Further advantages can be achieved by including boat speed data in the calculation. For example, the controller 12 can be configured to generate larger reaction torques when the boat is operating at higher speeds. This produces a system with higher sensitivity to external forces during higher speed operation. Thus, the operator can detect these reaction forces more quickly and thus respond with quick and stable steering operations during high speed running. Additionally, when external forces are less able to affect a stable running condition of the board, then the reaction torque can be reduced to save power.

Figure 3:
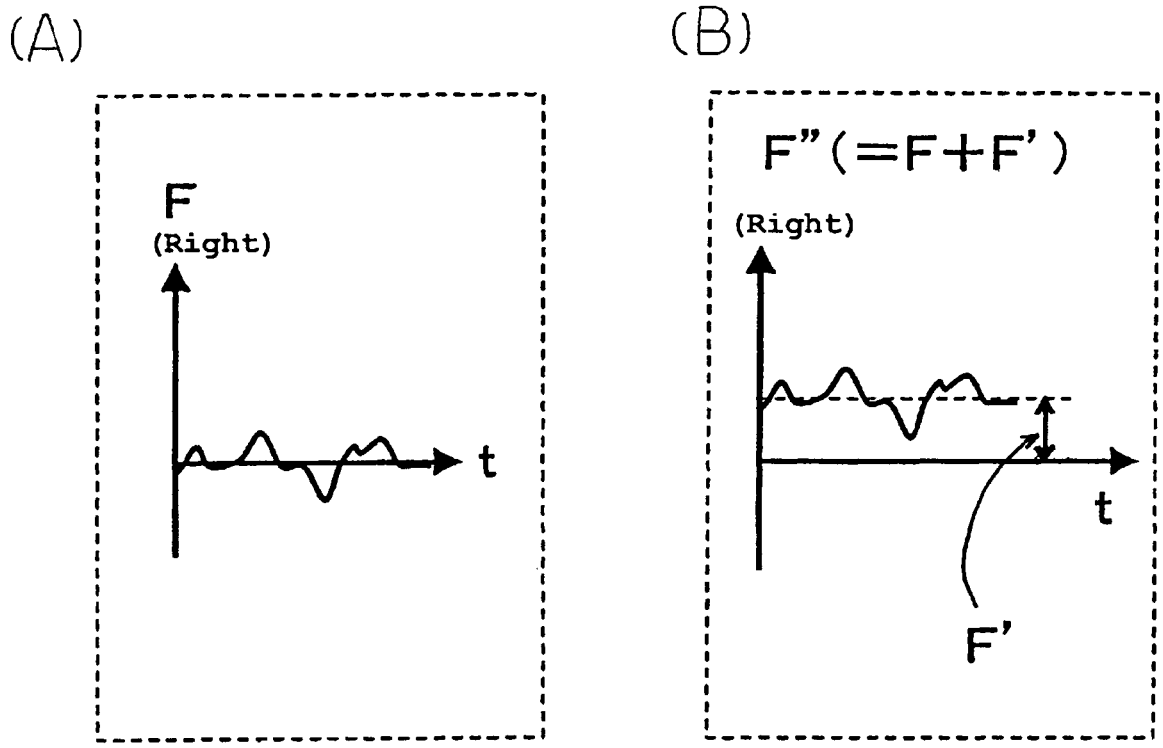
FIGS. 3*a* and 3*b* are graphs illustrating external forces that can act on a watercraft.

FIG. 3 illustrates external forces that can act on the hull 1. In FIG. 3, horizontal and vertical axises represent time and the external force, respectively, FIG. 3*a* illustrates an external force F that acts on the outboard motor 3 during running. In this example, a force that acts from the right side, as viewed in FIG. 2, is designated as a positive force. On the other hand, a force that acts from the left side, as viewed in FIG. 2, is designated as a negative force.

FIG. 3*b* shows a resultant force F" of the external force F added with a force due to paddle-rudder effect F'. The force due to the paddle-rudder effect F' can be predicted according to conditions such as propeller size, trim angle, boat speed, and engine speed during running. For example, as reflected in FIG. 3*b*, the value of the force F' remains generally constant under constant running conditions. FIG. 3*b* illustrates a running condition in which speed and direction are stable. In this case, if the force F' acts on the right side, the outboard motor 3 is urged leftward and thus the boat heading is deflected toward the right. The constant force F', plus the external force F shown in FIG. 3*a*, or the resultant force F", is detected by the load sensor 16 (FIG. 2).

Figure 4:
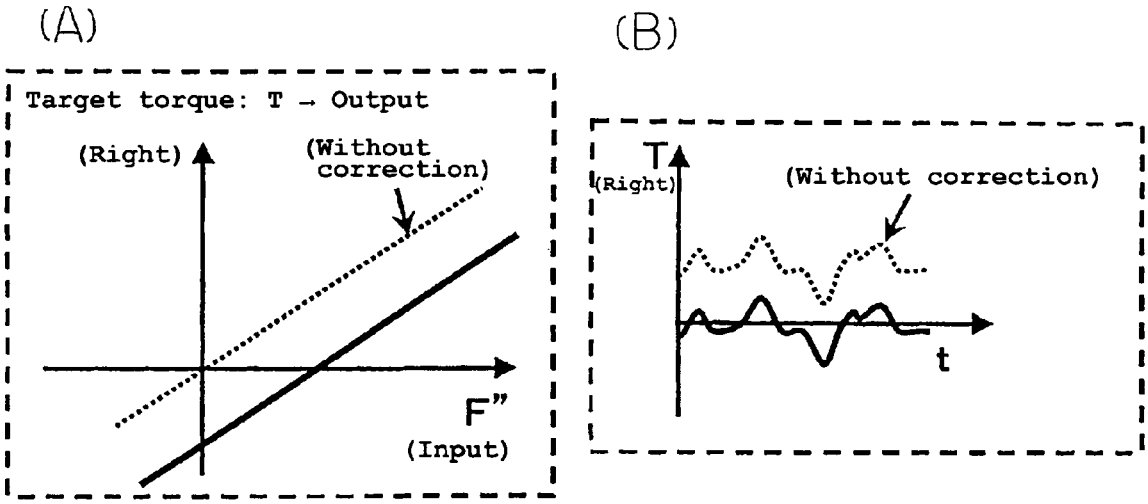
FIGS. 4*a* and 4*b* are graphs illustrating reaction forces and reaction torque calculation processes that can be used with the embodiment of FIG. 1.

FIG. 4 illustrates a mode of operation in which a reaction torque calculation process is used. The process can be performed in the reaction torque calculation circuit 17 (FIG. 2). FIG. 4*a* is a graph illustrating correction of the resultant force F" of the external forces detected in the foregoing description of FIG. 3*b*, for calculating a target torque. That is, a target torque T is output as a value without correction and is represented by a dotted line (the force F" as detected). Additionally, further advantages are achieved where the target torque T is calculated based on the detected force F" minus the force due to the paddle-rudder effect F'. In this mode, the target torque T is calculated under a condition where the force due to the paddle-rudder effect is subtracted, and then a reaction force is applied to the steering wheel 7 by the reaction torque motor 11 (FIG. 2).

FIG. 4*b* is a graph of the reaction force applied to the steering wheel 7. As shown in FIG. 4*b*, a reaction torque of the reaction force applied to the steering wheel 7 is represented as a graph (solid line), having been corrected by subtracting the force due to the paddle-rudder effect, as described above and with respect to FIG. 4*a*, from the data without correction shown by the dotted line (corresponding to FIG. 3*b*).

In this manner, or by other manners, by calculating a correction by subtracting the force due to the paddle-rudder effect, output energy can be reduced and the power consumption of the reaction torque motor 11 can thereby be lowered. Also, since the force due to the paddle-rudder effect which would act as a torque toward the left or right rotational direction of the steering wheel, can be removed. More accurate, left and right rotational torques on the steering wheel 7 can be attained. Thus, the operator can retain a balance handling response between left and right directions, allowing steering operation that provides a suitable driving feeling.

Additional reaction force adjusting means can be provided for allowing adjustment of the magnitude of reaction forces applied to the steering wheel 7. For example, such adjusting means can be configured to allow an operator to adjust the magnitudes of external forces perceived by the operator, to reduce a reaction force applied to the steering wheel to zero or other values, etc. Such an adjusting means can allow the setting of the magnitude of the reaction force applied to the steering wheel 7 according to the external forces so as to allow easy steering wheel operation depending on the operator's preferences, physical strengths, fatigues of the operator, and/or the running conditions of the boat.

Figure 5:
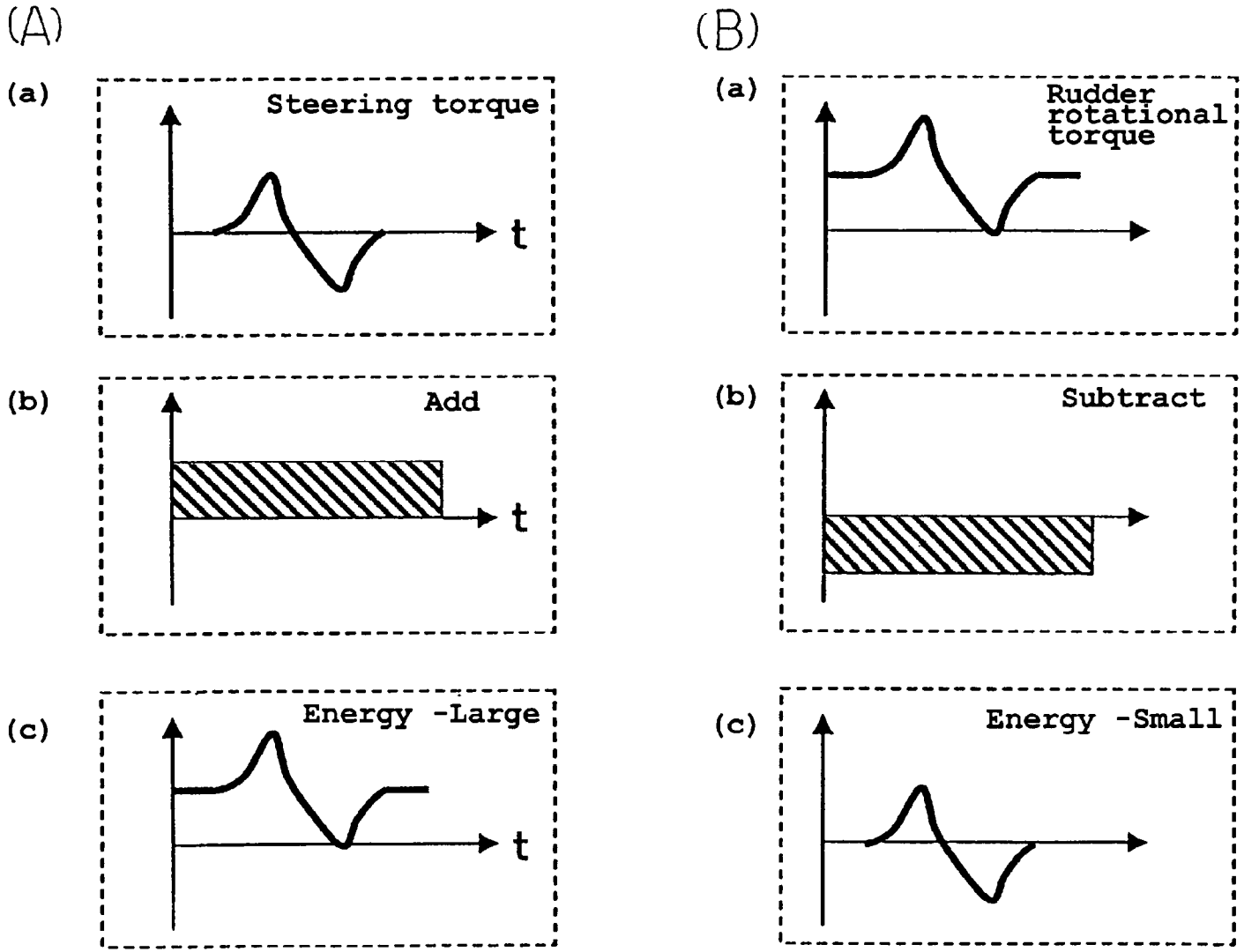
FIGS. 5*a* and 5*b* include graphs showing a contrast between prior art systems and the present electric steering system

FIG. 5 illustrates a contrast between a prior art system and the present electric steering system. FIG. 5*a* illustrates a manner of handling a force due to the paddle-rudder effect according to the prior art patent JP-B-2739208. FIG. 5*b* shows the handling of a force in accordance with the present electric steering system.

In FIGS. 5*a* and 5*b*, the upper most graph labels as (a) shows input data representing data generated from a steering wheel angle sensor. In other words, the solid line of graph (a) represents the signal output from the steering wheel angle sensor when the operator turns the wheel from a neutral position, towards the right, then towards the left, then back to a neutral position. The graph identified as (a) in FIG. 5*b* illustrates the detected force F" exerted on the rudder or outboard motor 3. As noted above, the resultant force F" includes both the torques generated by movement of the rudder dictated by the operator, as well as wind and wave forces on the rudder and the paddle-rudder effect.

In FIG. 5*a*, the graph identified as (b) illustrates that in the prior art systems, the forces (e.g., F') generated by the paddle-rudder effect remains part of the detected torque. In other words, the force F' is added with the forces exerted on the rudder. Thus, as shown in the graph identified as (c) of FIG. 5*a*, the reaction torque includes a component that results in a much higher energy use because the force generated by the paddle-rudder effect is not filtered out before the reaction torque motor signal is generated.

As shown in FIG. 5*b* and in the graph identified as (b), the generally constant force produced by the paddle-rudder effect is subtracted from the resultant force F". Thus, as shown in the graph of FIG. 5*b* identified as (c), the energy used to drive the reaction torque motor 11 is smaller because the generally constant bias created by the paddle-rudder effect has been eliminated.

What is claimed is:

1. A steering apparatus for a boat comprising a rudder device driven by an electric actuator arranged to change a running direction of the boat, a steering wheel configured to operable by an operator of the boat, the steering wheel being electrically connected to the electric actuator so as to feed a drive signal to the electric actuator according to an amount of operation, a load sensor configured to detect an external force that acts on the boat during running, a reaction torque motor configured to apply a reaction force to the steering wheel, and a reaction torque calculation module configured to calculate a target torque for the reaction torque motor by subtracting a force due to paddle-rudder effect from an output of the load sensor.

2. The steering apparatus according to claim 1, wherein a strength of the reaction force generated by the reaction torque motor is adjustable.

3. The steering apparatus according to claim 2, wherein the reaction torque calculation module is configured to calculate the target torque based on a speed of the boat.

4. The steering apparatus according to claim 2 further comprising a propulsion device for generating a thrust, wherein the rudder device performs steering by swinging the propulsion device to change a direction of the thrust.

5. The steering apparatus according to claim 1, wherein the reaction torque calculation module is configured to calculate the target torque based on a speed of the boat.

6. The steering apparatus according to claim 5 further comprising a propulsion device for generating a thrust, wherein the rudder device performs steering by swinging the propulsion device to change a direction of the thrust.

7. The steering apparatus according to claim 1 further comprising a propulsion device for generating a thrust, wherein the rudder device performs steering by swinging the propulsion device to change a direction of the thrust.

8. A steering apparatus for a boat comprising a rudder device driven by an electric actuator arranged to change a running direction of the boat, a steering wheel configured to operable by an operator of the boat, the steering wheel being electrically connected to the electric actuator so as to feed a drive signal to the electric actuator according to an amount of operation, a load sensor configured to detect an external force that acts on the boat during running, a reaction torque motor configured to apply a reaction force to the steering wheel, and means for calculating a target torque for the reaction torque motor by subtracting a force due to paddle-rudder effect from an output of the load sensor.

* * * * *